US008993903B2

(12) United States Patent
Skarlupka et al.

(10) Patent No.: US 8,993,903 B2
(45) Date of Patent: Mar. 31, 2015

(54) SEALED DUAL PLUNGER SWITCH ASSEMBLY WITH SIMULTANEITY

(75) Inventors: Michael J. Skarlupka, Freeport, IL (US); Matthew J. Brose, Davis, IL (US)

(73) Assignee: Honeywell International Inc., Morristown, NJ (US)

( * ) Notice: Subject to any disclaimer, the term of this patent is extended or adjusted under 35 U.S.C. 154(b) by 1343 days.

(21) Appl. No.: 11/880,672

(22) Filed: Jul. 23, 2007

(65) Prior Publication Data

US 2009/0026055 A1 Jan. 29, 2009

(51) Int. Cl.
*H01H 25/04* (2006.01)
*H01H 13/06* (2006.01)
*H01H 13/70* (2006.01)

(52) U.S. Cl.
CPC ..... *H01H 13/06* (2013.01); *H01H 13/70* (2013.01); *H01H 2221/072* (2013.01)
USPC ..... 200/5 R; 200/16 B

(58) Field of Classification Search
USPC ..... 200/16 R–16 F, 61.88–61.91, 5 R, 1 B
See application file for complete search history.

(56) References Cited

U.S. PATENT DOCUMENTS

| | | | | |
|---|---|---|---|---|
| 2,930,859 | A | 3/1960 | Nolden et al. | |
| 3,165,611 | A * | 1/1965 | Hagberg Hugo E | 200/529 |
| 3,624,330 | A * | 11/1971 | Bognar et al. | 200/534 |
| 3,699,293 | A * | 10/1972 | Portugall | 200/288 |
| 4,177,363 | A | 12/1979 | Keranen | |
| 4,758,694 | A * | 7/1988 | Burdick | 200/50.36 |
| 4,933,521 | A * | 6/1990 | Steward, Sr. | 200/342 |
| 5,534,672 | A * | 7/1996 | Meagher | 200/61.89 |
| 5,938,589 | A * | 8/1999 | Wako et al. | 600/159 |
| 6,433,091 | B1 * | 8/2002 | Cheng | 525/191 |
| 6,458,095 | B1 * | 10/2002 | Wirt et al. | 604/82 |
| 6,903,283 | B2 | 6/2005 | Skarlupka et al. | 200/16 B |
| 6,972,385 | B2 | 12/2005 | Klebs et al. | |
| 7,239,095 | B2 * | 7/2007 | Ho et al. | 315/505 |
| 2005/0082149 | A1 | 4/2005 | Skarlupka et al. | 200/16 |

FOREIGN PATENT DOCUMENTS

| | | | |
|---|---|---|---|
| DE | 2905792 | B1 | 6/1980 |
| EP | 0115281 | B1 | 4/1987 |
| FR | 2752085 | B3 | 10/1998 |
| JP | 08-222085 | A | 8/1996 |
| JP | 10-149736 | A | 6/1998 |
| JP | 2002-100273 | A | 4/2002 |
| KR | 20-0340573 | Y1 | 2/2004 |

OTHER PUBLICATIONS

Copy of International Search Report for corresponding Application Number EP 08796401 dated Jun. 25, 2014.

* cited by examiner

*Primary Examiner* — Shawki S Ismail
*Assistant Examiner* — Lisa N Homza
(74) *Attorney, Agent, or Firm* — Seager Tufte & Wickhem LLC.

(57) ABSTRACT

A sealed dual plunger switch assembly includes two switch sub-assemblies comprising plunger actuating mechanisms and basic switches. The sub-assemblies can be inserted into an overall enclosure using shims in order to position their operate points in the desired range relative to the enclosure's mounting surface. The enclosure is then sealed using a combination of covers, gaskets, o-rings, connectors and potting. The sub-assemblies individually and/or simultaneously receive actuation inputs within a fixed distance from the assembly's mounting surface.

19 Claims, 8 Drawing Sheets

SEALED DUAL PLUNGER SWITCH ASSEMBLY WITH SIMULTANEITY

TECHNICAL FIELD

Embodiments are generally related to electrical switches. Embodiments are also related to plunger actuating mechanisms utilized in switching devices. Embodiments are also related to sealed switch sub-assemblies within a common enclosure for maintaining actuation inputs at different plunger locations operating simultaneously within a fixed distance from the assembly's mounting surface.

BACKGROUND OF THE INVENTION

Many types of switch mechanisms are utilized in residential, commercial, industrial and military applications. A particular application of switch mechanisms of this type relate to pushbutton switches that comprise a plunger that is movable relative to a base along an axis and which causes actuation of switching components when the plunger is depressed. Typically, the plunger is connected to a button that is depressible by a human finger. Some switch mechanisms cause actuation of a switch upon each depression of the button and plunger while other switch applications, referred to as alternate action devices, actuate on one push and release of the button and undo the actuation on a subsequent push and release of the button.

Generally, a plunger switch is mounted to an electric appliance to control a lamp, a motor, a heater and so forth. Due to external pressure generated by electrical and mechanical elements, a point of contact of the plunger switch engages the electric appliance. Meanwhile, when the external pressure is eliminated, the contact of the plunger switch returns to an original position thereof, thus maintaining an operable position.

In many switch designs and other mechanically actuated devices, the plunger is utilized as the input mechanism to force some other action within the surrounding enclosure (i.e., case or housing). Plungers come in all different shapes and sizes but are usually retained in their respective enclosures by similar means. In most cases, a spring or similar feature can provide resistance to the actual movement of the plunger within the enclosure.

Many electrical switches are of the type which encounter "overtravel" after the state of the electrical connection of the switch has been altered. In most instances, an actuator is employed to operate the switch. The actuator and its associated components usually go through a "pretravel" before electrical connection is made or the switch state is altered, which sometimes is termed the "operating point". The actuator and/or its associated components go through an overtravel condition of movement after the operating point. Upon release of the actuator, reverse movement usually takes place and a "release point" occurs when the electrical connection and its associated circuit is transferred back to its original state. This usually occurs sometime during return movement of the actuator.

Plunger switch design inherently requires that actuating plunger travel must be the same as the return plunger travel plus movement differential before the switch can transfer the circuit to the original position. It further means that the actuation device and/or the switch mounting method must be designed to accommodate manufacturing tolerances in the involved apparatus components and still provide sufficient movement so that plunger travel through the operating point into the overtravel region will ensure that the switch can change states each time it is actuated. In many instances the attainment of these relations is complicated by the fact that normal manufacturing tolerances alone can be greater than the total travel (return plunger travel plus movement differential plus maximum permitted overtravel) of the switch thereby requiring the use of expensive and complicated mounting bracketry.

Based on the foregoing it is believed that a need exists for an improved sealed switch assembly that can receive actuation inputs at two different plunger locations. Additionally, a need exists for achieving the desired operating point of each plunger in a way such that they operate simultaneously within a fixed distance from the assembly's mounting surface.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for improved electrical switches.

It is another aspect of the present invention to provide for improved plunger actuating mechanism.

It is another aspect of the present invention to provide for an improved apparatus and method for maintaining dual plunger within a sealed switch enclosure.

The aforementioned aspects and other objectives and advantages can now be achieved as described herein. A sealed dual plunger switch assembly includes two switch sub-assemblies comprising a plunger actuating mechanism and basic switches. The sub-assemblies can be inserted into an overall enclosure using shims in order to position their operate points in the desired range relative to the enclosure's mounting surface. The enclosure is then sealed using a combination of covers, gaskets, o-rings, connectors and potting. The dual plunger switch assembly simultaneously receives actuation inputs at two plunger locations, and the plungers actuate two switch sub-assemblies within a fixed distance from the assembly's mounting surface. The dual plunger switch assembly can also receive only one actuation input, in which case only one switch sub-assembly would be actuated.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment of the invention and are not intended to limit the scope thereof.

Figure 1:
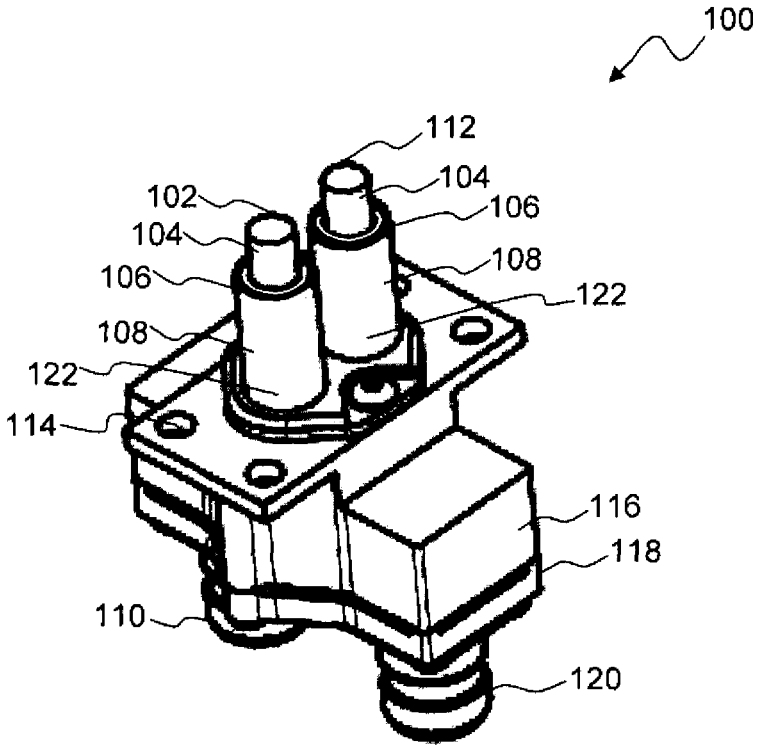
FIG. 1 illustrates a perspective view of a dual plunger switch assembly, in accordance with a preferred embodiment.

Referring to FIG. 1 a perspective view of a dual plunger switch assembly 100 is illustrated, in accordance with a preferred embodiment. Note that in FIGS. 1-7, identical or similar parts or elements are generally indicated by identical reference numerals. The dual plunger switch assembly 100 includes an enclosure 116 which surrounds a switch sub-assembly 102 and a switch sub-assembly 112. The switch assembly 100 further includes a pair of electrical connectors 110 and 120 which extends through a cover plate 118 attached to the enclosure 116 for communication with an external circuit.

Figure 2:
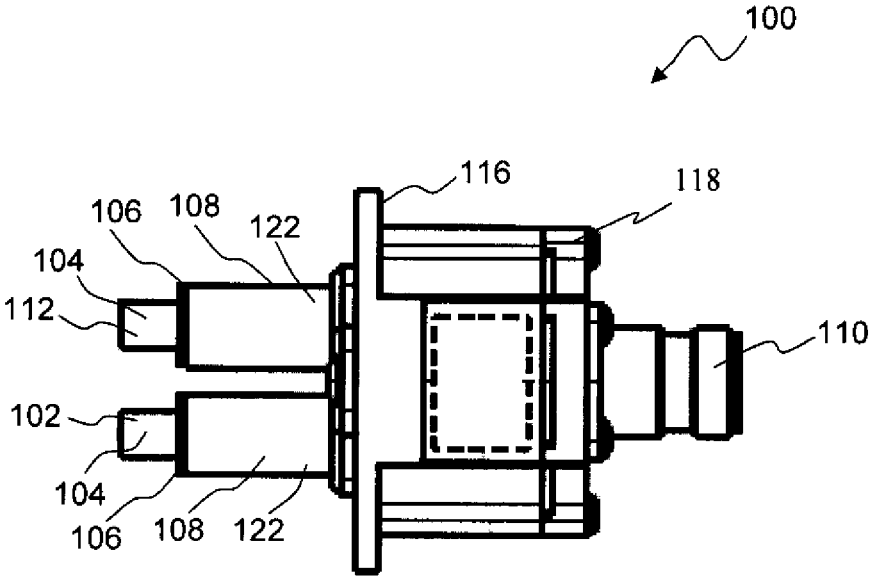
FIG. 2 illustrates a side perspective view of the dual plunger switch assembly depicted in FIG. 1, in accordance with a preferred embodiment.

Referring to FIG. 2 a side perspective view of the dual plunger switch assembly 100 depicted in FIG. 1 is illustrated, in accordance with a preferred embodiment.

Figure 3:
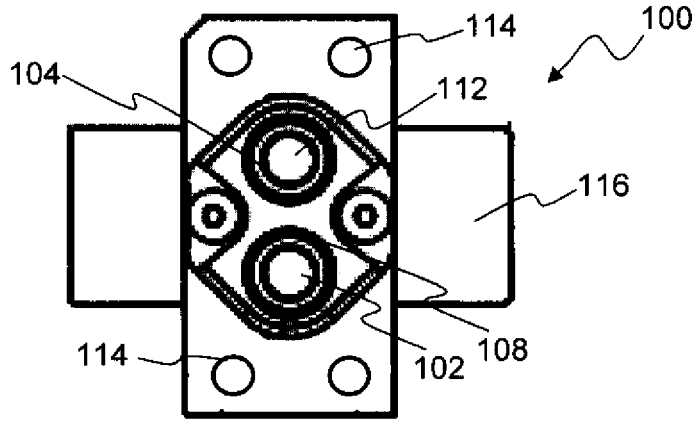
FIG. 3 illustrates a top view of the dual plunger switch assembly depicted in FIG. 1, in accordance with a preferred embodiment.

Referring to FIG. 3 a top view of the dual plunger switch assembly 100 depicted in FIG. 1 is illustrated, in accordance with a preferred embodiment. As indicated in FIG. 3, the dual plunger switch assembly 100 includes the switch sub-assembly 102, the switch sub-assembly 112, mounting holes 114 and the enclosure 116.

Figure 4:
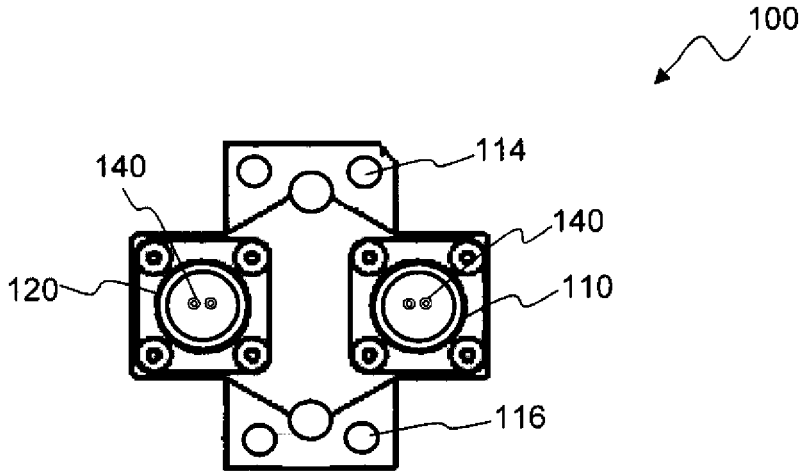
FIG. 4 illustrates a bottom view of the dual plunger switch assembly depicted in FIG. 1, in accordance with a preferred embodiment.

Referring to FIG. 4 a bottom view of the dual plunger switch assembly 100 depicted in FIG. 1 is illustrated, in accordance with a preferred embodiment. As indicated in FIG. 4 terminal contacts 140 are disposed within the openings formed in the electrical connectors 110 and 120, which provide communication to an external circuit.

Figure 5:
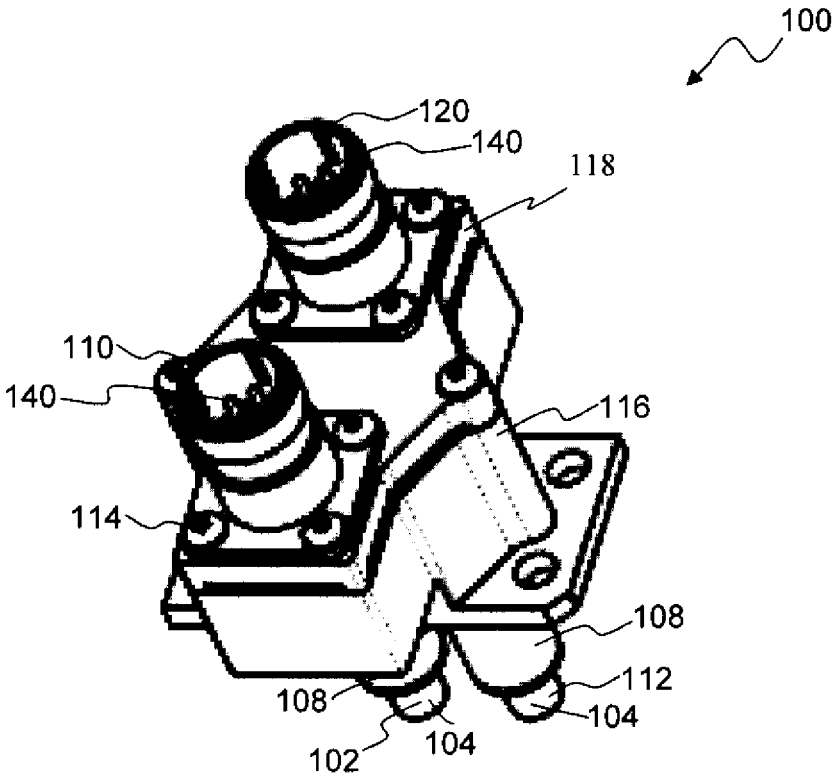
FIG. 5 illustrates another perspective view of the dual plunger switch assembly, in accordance with a preferred embodiment.

Referring to FIG. 5 another perspective view of the dual plunger switch assembly 100 is illustrated, in accordance with a preferred embodiment.

Figure 6:
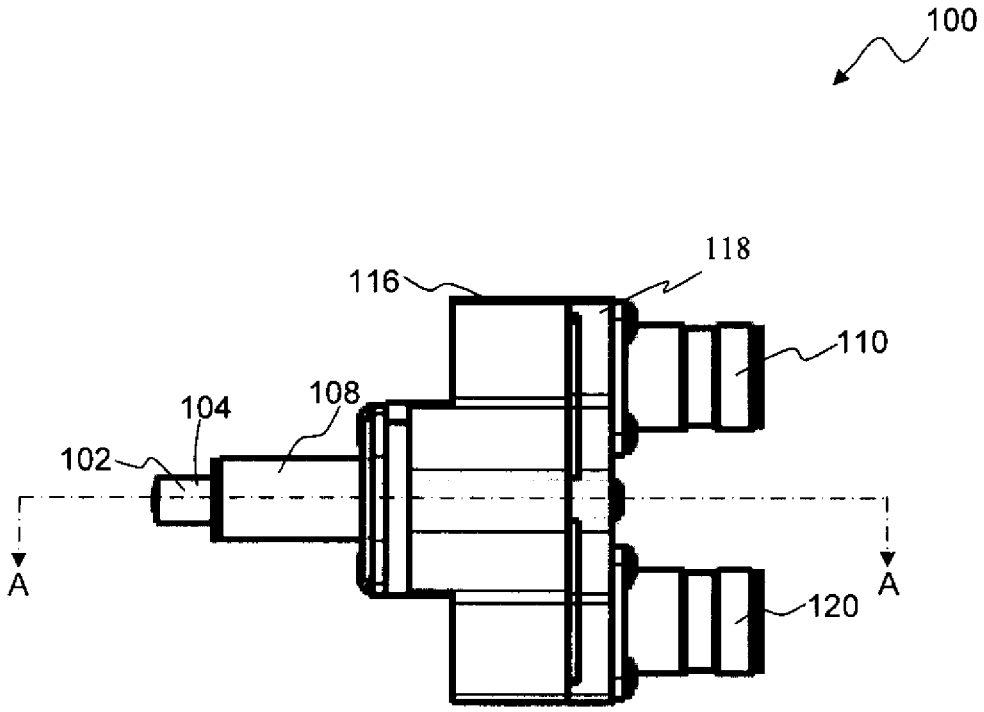
FIG. 6 illustrates side perspective view of the dual plunger switch assembly depicted in FIG. 5, in accordance with a preferred embodiment.

Referring to FIG. 6 side perspective view of the dual plunger switch assembly 100 depicted in FIG. 5 is illustrated, in accordance with a preferred embodiment.

Figure 7:
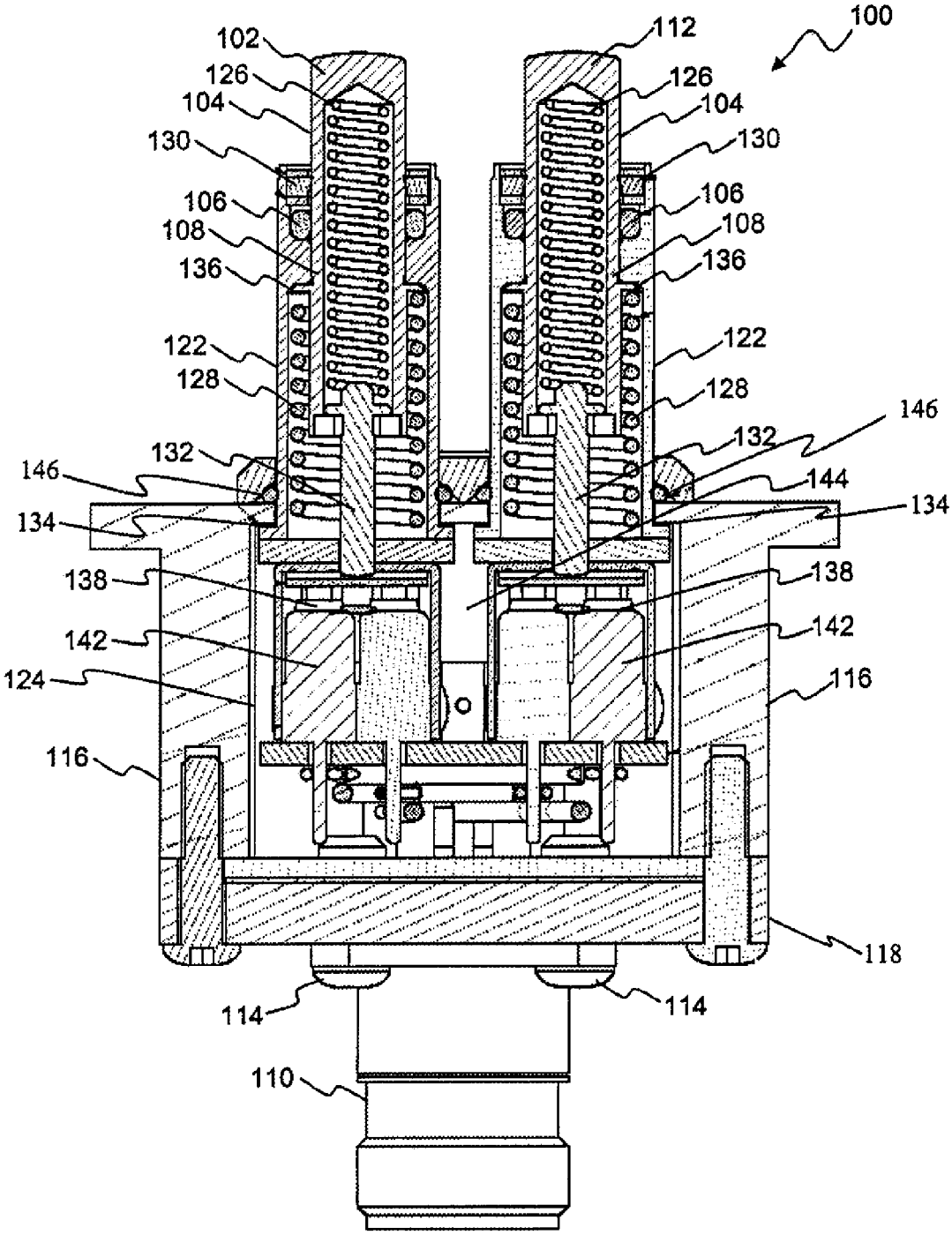
FIG. 7 illustrates a sectional view A-A of the dual plunger switch assembly depicted in FIG. 6, in accordance with a preferred embodiment.

Referring to FIG. 7 a cross-sectional view A-A of the dual plunger switch assembly 100 depicted in FIG. 6 is illustrated, in accordance with a preferred embodiment. The space between the switch sub-assembly bushings 122 and enclosure 116 and cover plate 118 defines an elongated interior cavity 144 as shown in FIG. 7 which houses the operative components of the switch assembly 100. The switch sub-assemblies 102 and 112 have a plunger 104 exposed exteriorly of the bushing 122 and a lower plunger portion 108 includes an enlarged diameter to define a shoulder 136, which rests against bushing 122 as shown in FIG. 7 when the switch assembly 100 is in its original or un-operated state. An O-ring 106 surrounds plunger 104 to seal the interior of bushing 122.

An ice scraper 130 as shown in FIG. 7 is provided above the O-ring 106 to protect the o-ring. The switch sub-assemblies 102 and 112 are positioned within the enclosure 116 using shims 134 to fix the normal and actuated positions of the switch sub-assemblies 102 and 112. The sealed switch assembly 100 can receive actuation inputs to the switch sub-assemblies 102 and 112 and the operating point for switch sub-assemblies 102 and 112 can be simultaneous and within about 0.010 inches of a fixed distance from the assembly's mounting surface. The switch sub-assemblies 102 and 112 can be fixed to the collar 124 by appropriate means, and the collar 124 is connected to the enclosure 116 using screws 114. O-rings 146 surround switch sub-assemblies 102 and 112 and seal between these sub-assemblies and enclosure 116.

Compression springs 128 as shown in FIG. 7 bias the plungers 108 away from the actuated position toward the normal position. The switch sub-assemblies 102 and 112 can be depressed which commences compressing a first compression spring 128. As first compression spring 128 is compressed this allows internal plunger 132 to act against lever 138 which actuates the basic switch elements 142 causing the electrical contacts to change state. The change in state of the electrical contacts is communicated to the external circuit via conductors 148 fixed to the terminals of switch elements 142 and the electrical contacts 140 of electrical connectors 110 and 120. Second compression spring 126 as shown in FIG. 7 will also compress when the switch sub-assemblies 102 and 112 are actuated by an amount greater than that needed to cause the electrical contacts to change state. The spring 128 as shown in FIG. 7 serves as a return spring for the plungers 108 when pressure on the switch sub-assemblies 102 and 112 is released.

Figure 8:
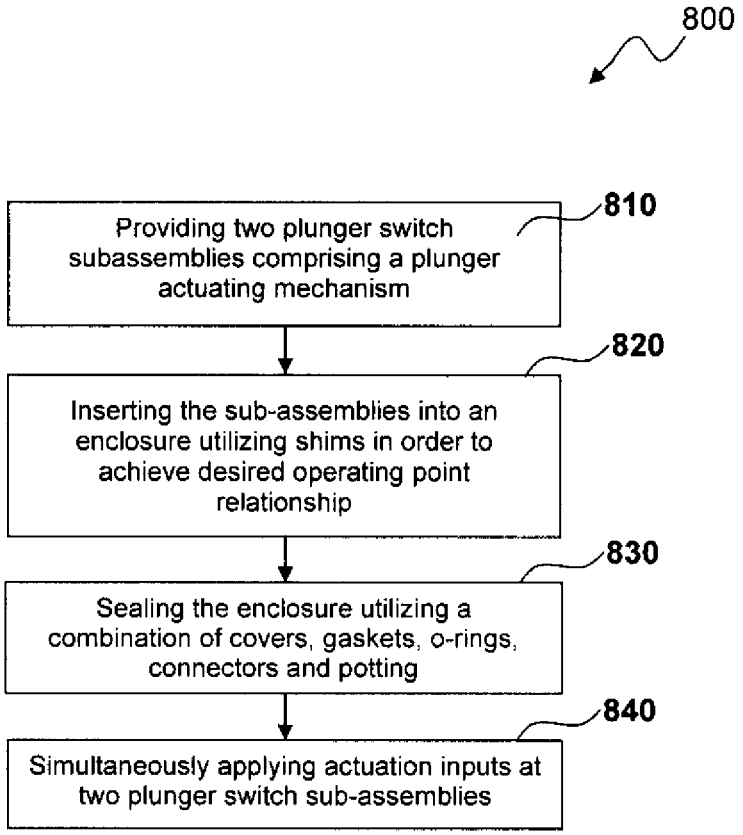
FIG. 8 illustrates a high-level flow chart of operations depicting a method for forming a sealed dual plunger switch assembly, in accordance with a preferred embodiment.

Referring to FIG. 8 a high-level flow chart of operations depicting a method for forming a sealed dual plunger switch assembly 800 is illustrated, in accordance with a preferred embodiment. Two plunger switch subassemblies 102 and 112 comprising a plunger actuating mechanism can be provided, as shown at block 810. The sub-assemblies 102 and 112 can then be inserted into an enclosure 116 utilizing shims 134 in order to achieve desired operating point relationship, as illustrated at block 820. Thereafter, as depicted at block 830, the enclosure 116 can be sealed utilizing a combination of covers 118, gaskets, o-rings 106 and 146, connectors 110 and 120 and potting. Actuation inputs can be applied either individually or simultaneously to the two plunger switch sub-assemblies 102 and 112, as shown at block 840.

Figure 9:
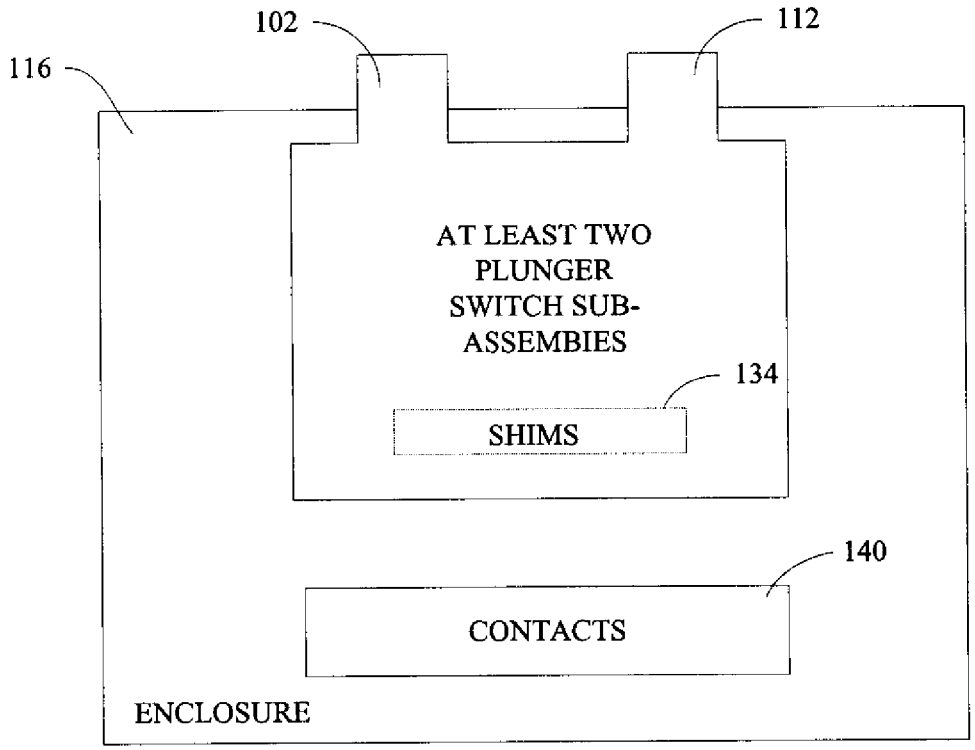
FIG. 9 is a schematic diagram of dual plunger switch enclosure apparatus.

FIG. 9 is a dual plunger switch enclosure apparatus, comprising an enclosure 116 having a plurality of walls, a plurality of electrical contacts 140 associated with said enclosure 116 for establishing an electrical connection, and at least two plunger switch sub-assemblies 102 and 112 associated with said enclosure 116 which are movable over a predetermined range, in order to alter the state of electrical connection in response to movement of said at least two plungers from a normal position to an actuated position. The apparatus further comprising a plurality of shims 134 associated with said at least two switch sub-assemblies 102 and 112 being inserted into said enclosure 116 in order to achieve an operating point of said at least two switch sub-assemblies 102 and 112 in a desired range.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A dual plunger switch enclosure apparatus, comprising:

an enclosure having a plurality of walls;

a plurality of electrical contacts associated with said enclosure for establishing an electrical connection;

at least two plunger switch sub-assemblies associated with said enclosure which are movable over a predetermined range, in order to alter the state of the electrical connection in response to movement of said at least two plunger switch sub-assemblies from a normal position to an actuated position; and a plurality of shims associated with said at least two plunger switch sub-assemblies being inserted into said enclosure in order to achieve an operating point of said at least two plunger switch sub-assemblies in a desired range.

2. The apparatus of claim 1 further comprising;

a plurality of o-rings associated with said at least two plunger switch sub-assemblies, wherein said o-rings are configured to surround and provide a seal to said plunger switch sub-assemblies.

3. The apparatus of claim 2 wherein each of said at least two plunger switch sub-assemblies comprise an operating end mounted for movement in said enclosure.

4. The apparatus of claim 2 wherein each of said at least two plunger switch sub-assemblies comprise an exterior plunger portion and an interior switching element portion.

5. The apparatus of claim 2 wherein said enclosure is environmentally sealed.

6. The apparatus of claim 2 wherein said at least two plunger switch sub-assemblies individually and/or simultaneously receive actuation inputs.

7. The apparatus of claim 1 wherein said at least two plunger switch sub-assemblies each comprise an exposed operating end mounted for movement in said enclosure.

8. The apparatus of claim 1 wherein said at least two plunger switch sub-assemblies each comprise an exterior plunger portion and an interior switching element portion.

9. The apparatus of claim 1 wherein said enclosure is environmentally sealed.

10. The apparatus of claim 1 wherein said at least two plunger switch sub-assemblies individually and/or simultaneously receive actuation inputs.

11. A dual plunger switch enclosure apparatus, comprising:

an enclosure having a plurality of walls;

a plurality of electrical contacts associated with said enclosure for establishing an electrical connection;

at least two plunger switch sub-assemblies associated with said enclosure which are movable over a predetermined range, in order to alter the state of said electrical connection in response to movement of said at least two plunger switch sub-assemblies from a normal position to an actuated position;

an o-ring associated with each of said at least two plunger switch sub-assemblies, wherein said o-rings are configured to surround and provide a seal to said plunger switch sub-assemblies; and a plurality of shims associated with said at least two plunger switch sub-assemblies being inserted into said enclosure in order to achieve an operating point of said at least two plunger switch sub-assemblies in a desired range.

12. The apparatus of claim 11 wherein each of said at least two plunger switch sub-assemblies comprises an exposed operating end mounted for movement in said enclosure.

13. The apparatus of claim 11 wherein each of said at least two plunger switch sub-assemblies comprises an exterior plunger portion and an interior switching element portion.

14. The apparatus of claim 11 wherein said enclosure is environmentally sealed.

15. The apparatus of claim 11 wherein said at least two plunger switch sub-assemblies individually and/or simultaneously receive actuation inputs.

16. A dual plunger switch assembly comprising:

an enclosure having a plurality of walls;

an electrical contact associated with the enclosure for selectively establishing an electrical connection;

a switch sub-assembly including a first plunger portion and a second plunger portion, the switch sub-assembly being actuatable between an activated state and an unactivated state for selectively establishing an electrical connection with the electrical contact, wherein the first plunger portion includes a bushing sized to moveably receive a portion of the second plunger portion, wherein the switch sub-assembly includes a first spring and a second spring, the first spring configured to bias the first plunger portion to a position extending outward from the enclosure and the second spring configured to bias the second plunger portion to a position extending outward from the first plunger portion; and one or more shims associated with the switch sub-assembly, the one or more shims being inserted into the enclosure in order to achieve a desired operating switch point of the switch sub-assembly.

17. The dual plunger switch assembly of claim 16 wherein the first spring is configured to compress before the second spring.

18. The dual plunger switch assembly of claim 17 wherein compression of the first spring alone establishes an operation switch point of the switch sub-assembly to establish the electrical connection.

19. The dual plunger switch assembly of claim 18 wherein compression of the second spring allows overtravel of the switch sub-assembly.

* * * * *